US009487983B2

(12) United States Patent
Choi et al.

(10) Patent No.: US 9,487,983 B2
(45) Date of Patent: Nov. 8, 2016

(54) DETENT HOOD HINGE

(71) Applicants: Hyundai Motor Company, Seoul (KR); Pyeong Hwa Automotive Co., Ltd., Daegu (KR)

(72) Inventors: Jae-Hoon Choi, Hwaseong-si (KR); Yong-Ju Kim, Suwon-si (KR)

(73) Assignees: Hyundai Motor Company, Seoul (KR); Pyeong Hwa Automotive Co., Ltd., Daegu (KR)

( * ) Notice: Subject to any disclaimer, the term of this patent is extended or adjusted under 35 U.S.C. 154(b) by 0 days.

(21) Appl. No.: 14/839,156

(22) Filed: Aug. 28, 2015

(65) Prior Publication Data

US 2016/0215547 A1 Jul. 28, 2016

(30) Foreign Application Priority Data

Jan. 27, 2015 (KR) ..... 10-2015-0012551

(51) Int. Cl.
*E05D 11/10* (2006.01)

(52) U.S. Cl.
CPC ..... *E05D 11/1007* (2013.01); *E05D 11/1014* (2013.01); *Y10T 16/540257* (2015.01)

(58) Field of Classification Search
CPC ..... E05D 11/1007; E05D 11/1014; E05D 3/125; E05D 3/18; F16C 11/10; E05C 17/24; B62D 25/12; Y10T 16/540257; Y10T 16/5406; Y10T 16/5409; Y10T 16/544; Y10T 16/547; Y10T 16/53885; B60R 21/38
USPC ..... 16/332, 348, 352, 357, 366, 306; 296/193.11; 180/69.21; 403/116
See application file for complete search history.

(56) References Cited

U.S. PATENT DOCUMENTS

| | | | | |
|---|---|---|---|---|
| 4,206,944 | A * | 6/1980 | Kumagai | E05D 3/18 180/69.21 |
| 6,269,521 | B1 * | 8/2001 | Gabel | E05D 3/145 16/287 |
| 6,401,299 | B1 * | 6/2002 | Schwarz | E05D 11/105 16/335 |
| 6,892,843 | B2 | 5/2005 | Schillaci et al. | |
| 7,845,053 | B2 * | 12/2010 | Marsh | E05D 11/06 16/286 |
| 7,934,293 | B2 * | 5/2011 | Kalargeros | B60R 21/38 16/357 |

FOREIGN PATENT DOCUMENTS

| | | | |
|---|---|---|---|
| JP | 2003-184856 | A | 7/2003 |
| JP | 2012-25241 | A | 2/2012 |
| KR | 10-1564189 | B1 | 10/2015 |
| WO | WO 2008/074136 | A1 | 6/2008 |

* cited by examiner

*Primary Examiner* — William Miller
(74) *Attorney, Agent, or Firm* — Morgan, Lewis & Bockius LLP

(57) ABSTRACT

A detent hood hinge which includes a hinge bracket fixed to a vehicle body, and a hinge arm rotatably coupled to the hinge bracket at a first end, a hood being coupled to a second end of the hinge arm may include a detent bracket coupled to the hinge arm and having a slide hole perforated on one side, a sleeve pin mounted so as to protrude from the slide hole at one end and coupled to the detent bracket so as to be slidable along the slide hole, a spring configured to be elastically deformed in accordance with sliding of the sleeve pin, and a lock stopper fixed to the hinge bracket and formed with a seating groove.

4 Claims, 5 Drawing Sheets

DETENT HOOD HINGE

CROSS-REFERENCE TO RELATED APPLICATION

The present application claims priority to Korean Patent Application No. 10-2015-0012551 filed Jan. 27, 2015, the entire contents of which is incorporated herein for all purposes by this reference.

BACKGROUND OF THE INVENTION

1. Field of the Invention

The present invention relates to a detent hood hinge that can maintain an open state by itself when a hood is opened. More particularly, the present invention relates to a detent hood hinge that can maintain the open state, even if a stay rod or a gas lifter for supporting the load of the hood in the conventional structure is removed.

2. Description of Related Art

In general, in an engine room of a passenger vehicle, a hood is covered on the upper side to protect the internal components and execute the sound insulating and sound absorbing functions. Although the hood can have various shapes and opening and closing forms depending on the arrangement forms of the engine and a vehicle model, generally, the hood has a structure in which a rear side is rotatably coupled to a hinge bracket fixed to a vehicle body via a hinge arm, a front side opened by being raised, and the rotation is regulated by unity of a striker and a latch.

The hood is opened during maintenance of the vehicle and replenishment of consumables, and is configured (conventionally) so that the load of the hood is supported by a stay rod, a gas lifter or the like to maintain the opened state.

However, there has been a problem in that, in order to mount the stay rod, the gas lifter or the like, it is necessary to provide an additional mounting space, and the cost of production also increases.

Accordingly, a main object of the present invention is to provide a detent hood hinge which can voluntarily support the rotation of the hinge arm connected to the hood so as to be able to remove the conventional stay rod, the gas lifter or the like for supporting the load of the hood.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a detent hood hinge to solve the above-described problems associated with prior art.

According to various aspects of the present invention, a detent hood hinge which includes a hinge bracket fixed to a vehicle body, and a hinge arm rotatably coupled to the hinge bracket at a first end, a hood being coupled to a second end of the hinge arm may include a detent bracket coupled to the hinge arm and having a slide hole perforated on one side, a sleeve pin mounted so as to protrude from the slide hole at one end and coupled to the detent bracket so as to be slidable along the slide hole, a spring configured to be elastically deformed in accordance with sliding of the sleeve pin, and a lock stopper fixed to the hinge bracket and formed with a seating groove, in which the sleeve pin is configured to slide along a surface of the lock stopper by rotation of the hinge arm and to be seated on or disengaged from in the seating groove in accordance with a rotation angle of the hinge arm.

The spring comprises a detent spring and a return spring, the detent spring is disposed on a first side of the sleeve pin, and the return spring is disposed on a second side of the sleeve pin.

When the hinge arm is in a state of being raised at a predetermined angle, the sleeve pin may be seated on the seating groove, and when the hinge arm rotates so as to be further raised, the sleeve pin may be disengaged from the seating groove.

The sleeve pin may be configured to slide by being fitted to a rod mounted in the detent bracket.

When the hinge arm is in a state of being raised at a predetermined angle, the sleeve pin may be seated on the seating groove, and when the hinge arm rotates so as to be further raised, the sleeve pin may be disengaged from the seating groove.

Since the present invention having the above-described configuration can remove the conventional stay rod and the gas spring, it is possible to reduce the production cost, and since the mounting space of the stay rod and the gas spring is eliminated, it is possible to increase the freedom of design of the engine room.

It is understood that the term "vehicle" or "vehicular" or other similar terms as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuel derived from resources other than petroleum). As referred to herein, a hybrid vehicle is a vehicle that has two or more sources of power, for example, both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

The present invention relates to a detent hood hinge which includes a hinge bracket 50 fixed to a vehicle body, and a hinge arm 60 rotatably coupled to the hinge bracket 50 at one end, a hood being coupled to the other end of the hinge arm 60. Various embodiments of the present invention will be described in more detail below with reference to the drawings.

Figure 1:
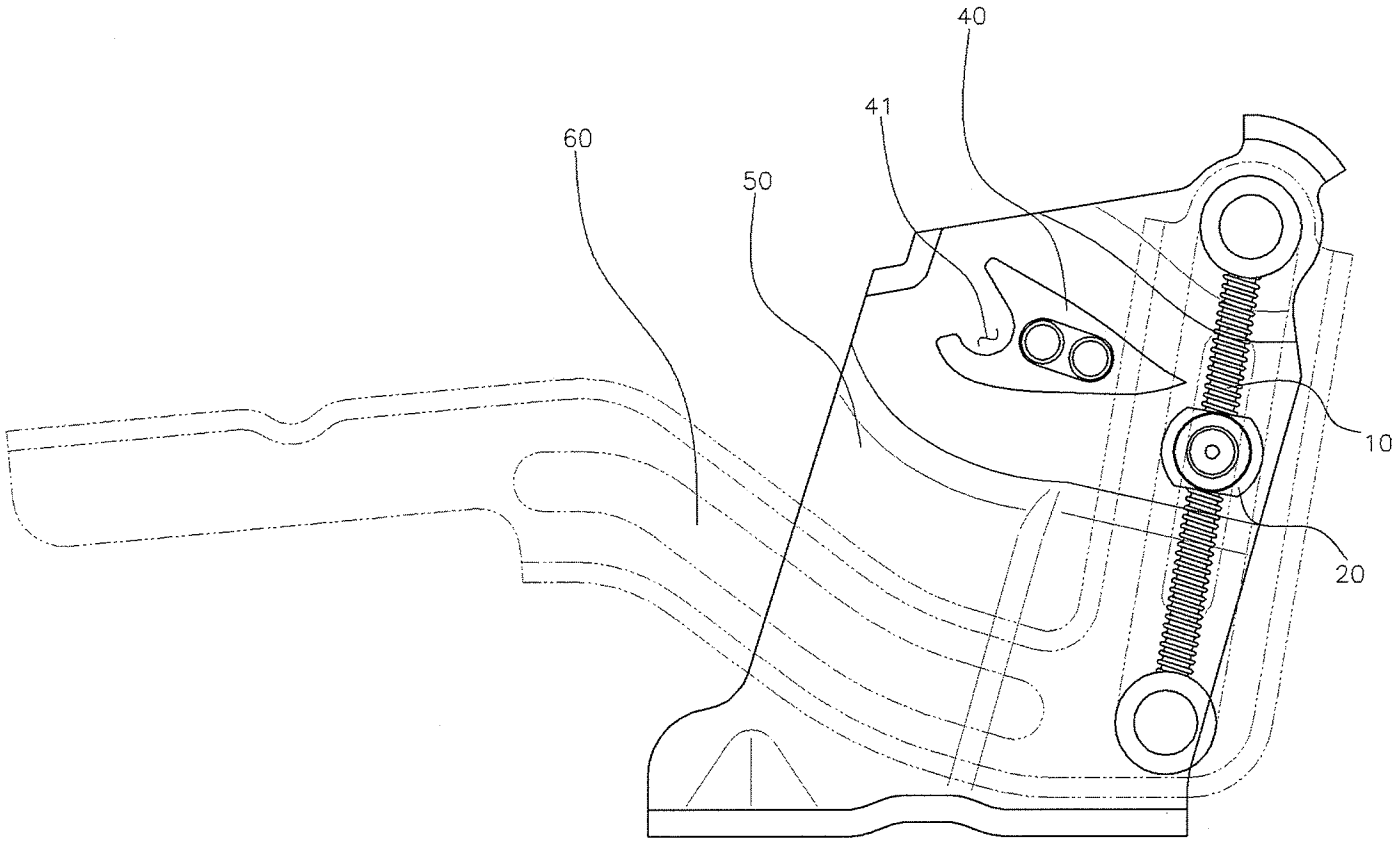
FIG. 1 is a diagram illustrating a side appearance of an exemplary detent hood hinge according to the present invention.

Referring to FIG. 1, the hinge bracket 50 is fixed to the vehicle body at a lower end, and the hinge arm 60 is rotatably coupled to an upper end thereof. A hood is coupled to a distal end of the hinge arm 60, and the hinge arm rotates in accordance with the opening and closing of the hood.

Moreover, a lock stopper 40 having a seating groove 41 formed at one side is additionally mounted to the hinge bracket 50, and a detent bracket 30 and a sleeve pin 20 fitted to a rod 10 are further mounted to the hinge arm 60.

The rod 10 is fixed to the hinge arm 60 by two bushes 11*a*, 11*b* coupled to both ends thereof, and the rod 10 is mounted in a state in which the sleeve pin 20 and two springs 12, 13 are coupled to each other. The springs include a detent spring 12 and a return spring 13, and each of them is disposed on both sides of the sleeve pin 20 so that the sleeve pin 20 is positioned at the center.

Figure 2:
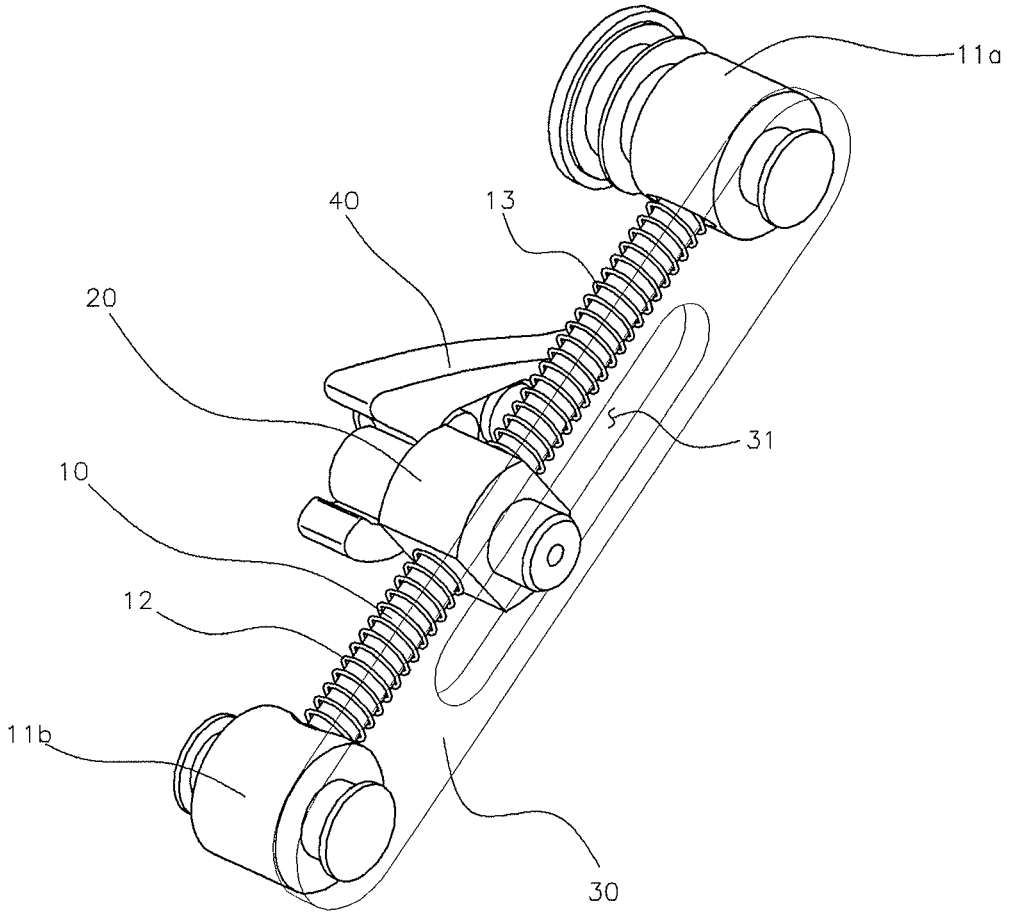
FIG. 2 is a diagram illustrating a state in which a sleeve pin is seated on a seating groove according to the present invention.
Figure 3:
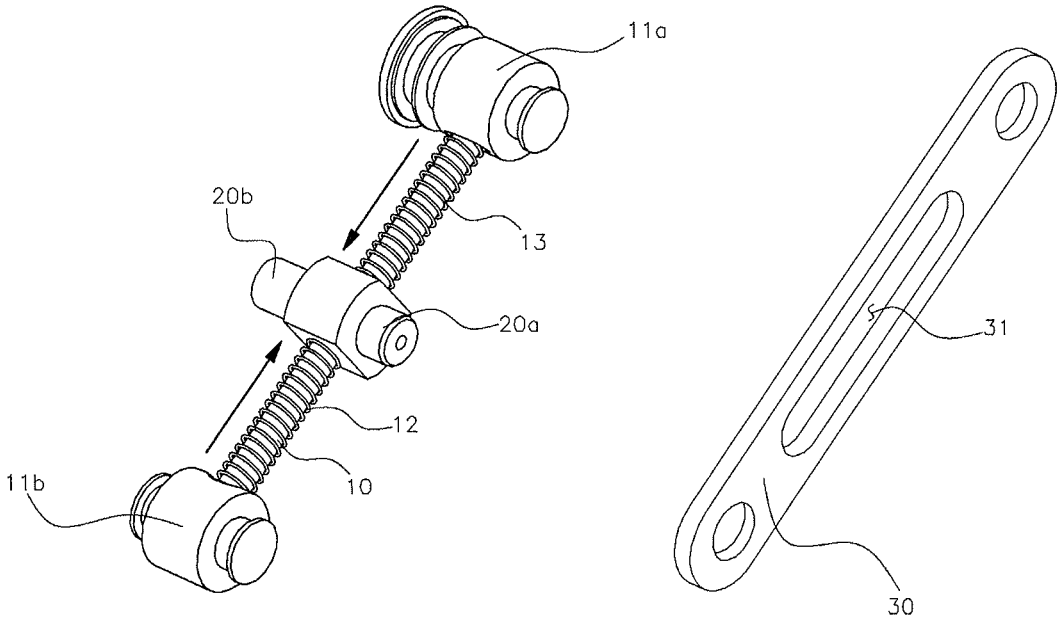
FIG. 3 is a diagram illustrating an appearance in which the sleeve pin and a detent bracket fitted to a rod are separated.

As illustrated in FIG. 2 and FIG. 3, the detent bracket 30 is coupled to the hinge arm 60 by being mounted to the bushes 11*a*, 11*b*, and a slide hole 31 is perforated on one side surface. Both ends of the sleeve pin 20 protrude (by being fitted to the rod 10 so as to form a right angle) to the length that allows one end 20*a* to be fitted to the slide hole 31, and allows the other end 20*b* to be fixed to the seating groove 41 of the lock stopper 40.

Thus, the sleeve pin 20 slides so as to abut against the surface along the periphery of the lock stopper 40 by the rotation of the hinge arm 60, and can be seated on or disengaged from the seating groove 41 depending on the rotation angle of the hinge arm 60. Although the lock stopper 40 according to various embodiments of the present invention can be formed in various forms, it has a form that has a shape such as a pointed arrow at one side, and is formed with the seating groove 41 at the other side.

Figure 4:
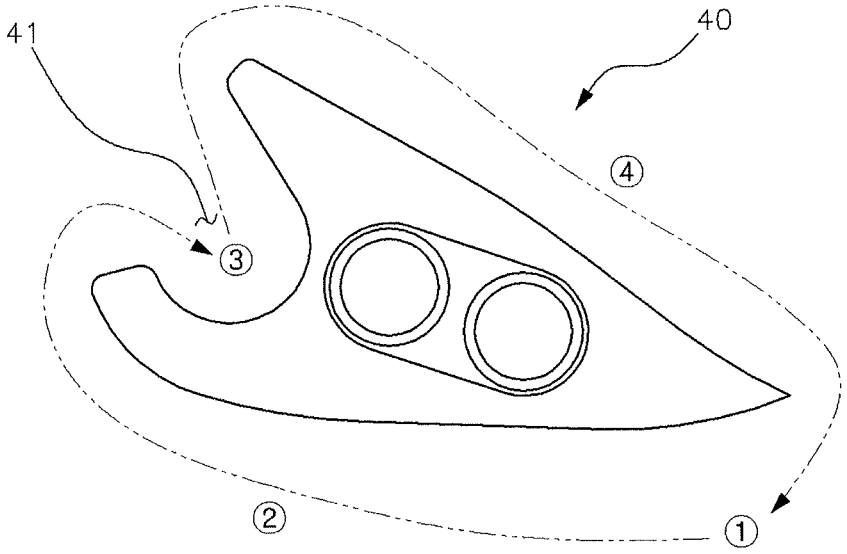
FIG. 4 is a diagram illustrating an appearance of a lock stopper according to the present invention.
Figure 5:
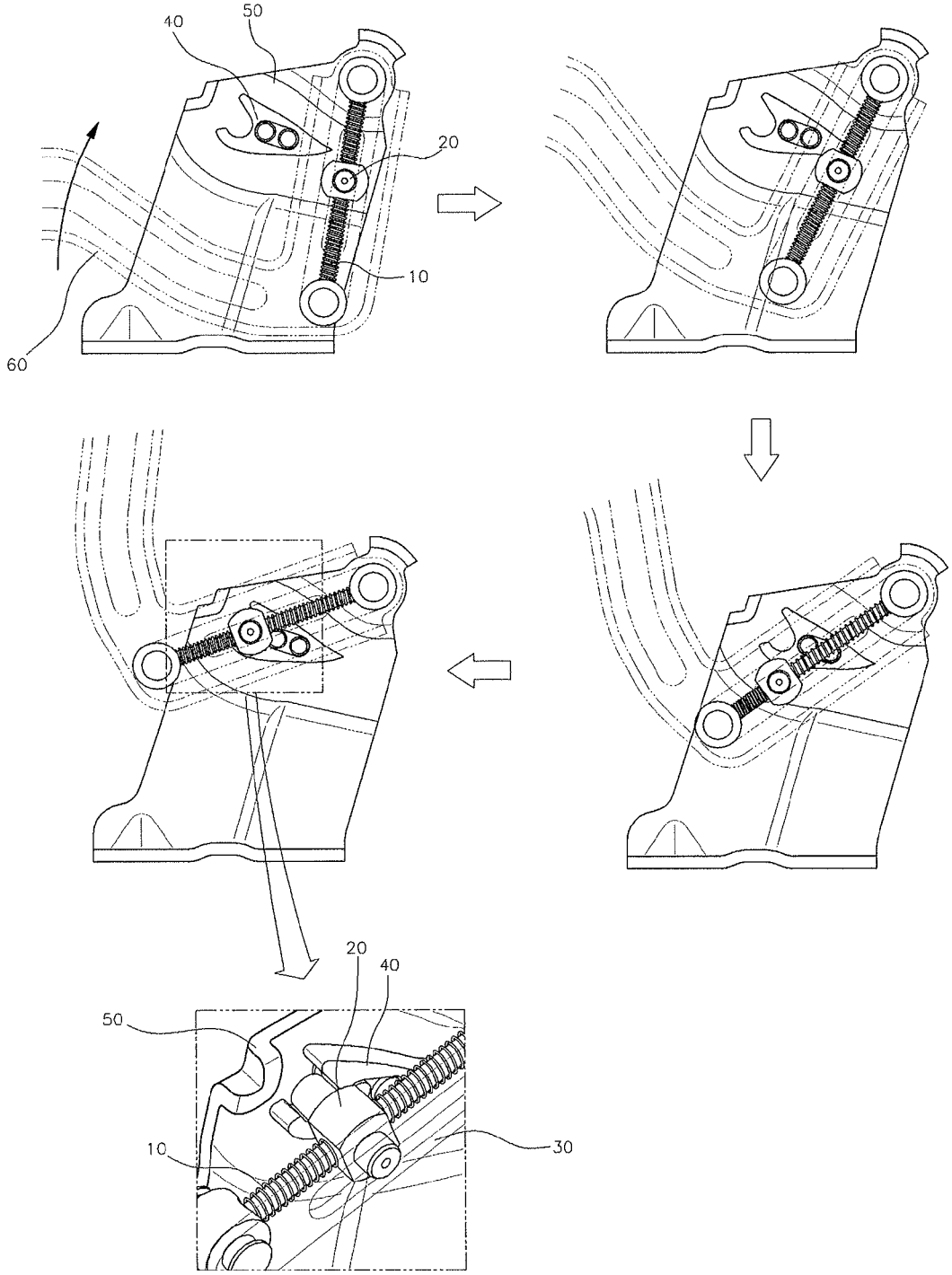
FIG. 5 is a diagram sequentially illustrating appearances of behavior of the sleeve pin when a hood rotates from a closed state to an opened state.

Referring to FIG. 4, when the hood is completely closed, the sleeve pin 20 is placed at a position (position indicated by ①) of a lower one side of the lock stopper 40. As the hood and the hinge arm 60 rotate as illustrated in FIG. 5, the sleeve pin 20 slides in a state of abutting against the lower end side of the lock stopper 40, and is seated at a position of ③, that is, the seating groove 41 along a pathway of ②. At this time, an operator can grasp the state in which the sleeve pin 20 abuts against the seating groove 41 (the state of raising the hood) through sense of touch. When releasing the food in this state, since the distal end 20*b* of the sleeve pin is seated on the seating groove 41, the rotation of the hinge arm 60 is controlled, and the opened state of the hood is maintained.

Figure 6:
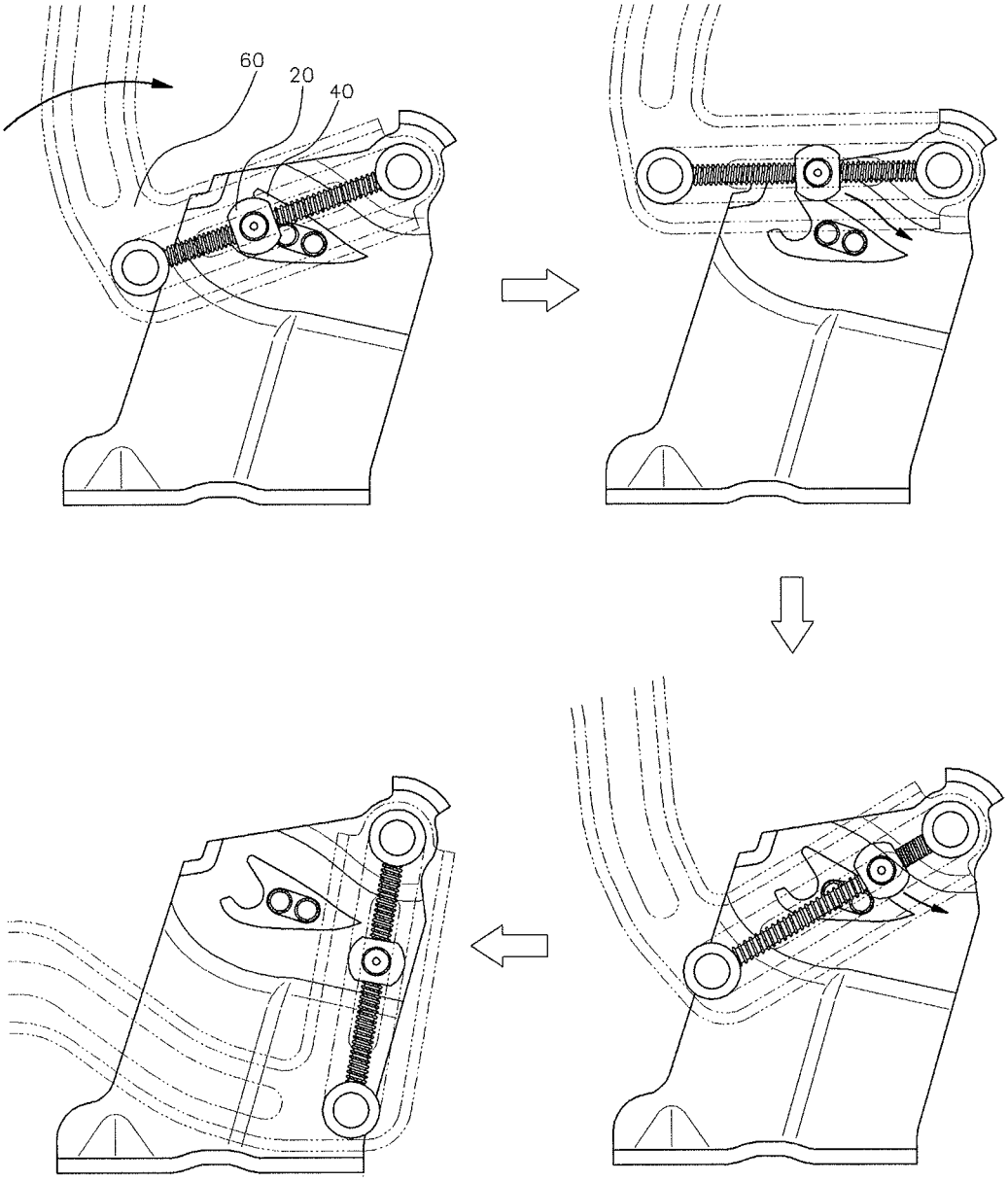
FIG. 6 is a diagram sequentially illustrating appearances of the behavior in which the sleeve pin is disengaged from the seating groove when the hood rotates from the opened state to the closed state.

Moreover, when the operator additionally raises the hood, the distal end 20*b* of the sleeve pin 20 is disengaged from the seating groove 41 along the pathway of ④, and the sleeve pin 20 is returned to the position of ① by the behavior of the hinge arm 60 and the elastic force of the spring as illustrated in FIG. 6.

That is, in the present invention, the sleeve pin 20 is seated on the seating groove 41 when the hood is in the state of being raised at a predetermined angle, and after the rotating arm 60 rotates so that the hood is additionally raised, when the hinge arm 60 rotates so that the hood is closed again (along the pathway of ④), the sleeve pin 20 is disengaged from the seating groove 41.

Meanwhile, although various embodiments of the present invention describe the single seating groove 41, two or more seating grooves 41 may be formed so as to be able to support the load of the hood at each of the two or more open angles of the hood.

In addition, in the present invention, the elastic force acts so that when the sleeve pin 20 slides in the state of abutting against the surface of the lock stopper 40, the spring prevents the disengagement, and when the hood is closed, the sleeve pin located at the position of ①. Since both the detent spring 12 and the return spring 13 are configured so that an elastic force acts on both sides to each of the sleeve pin 20, it is possible to suppress an occurrence of noise by further bringing the sleeve pin 20 into close contact with the surface of the lock stopper 40, and since the elastic force is dispersed and compensated with each other, it is possible to further improve the durability.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the claims appended hereto and their equivalents.

What is claimed is:

1. A detent hood hinge which includes a hinge bracket fixed to a vehicle body, and a hinge arm rotatably coupled to the hinge bracket at a first end, a hood being coupled to a second end of the hinge arm, the detent hood hinge comprising:

a detent bracket coupled to the hinge arm and having a slide hole perforated on one side;

a sleeve pin mounted so as to protrude from the slide hole at one end and configured to slide by being fitted to a rod mounted in the detent bracket;

a spring configured to be elastically deformed in accordance with sliding of the sleeve pin; and a lock stopper fixed to the hinge bracket and formed with a seating groove, wherein the sleeve pin is configured to slide along a surface of the lock stopper by rotation of the hinge arm and to be seated on or disengaged from in the seating groove in accordance with a rotation angle of the hinge arm.

2. The detent hood hinge of claim 1, wherein the spring comprises a detent spring and a return spring, the detent spring is disposed on a first side of the sleeve pin, and the return spring is disposed on a second side of the sleeve pin.

3. The detent hood hinge of claim 2, wherein when the hinge arm is in a state of being raised at a predetermined angle, the sleeve pin is seated on the seating groove, and when the hinge arm rotates so as to be further raised, the sleeve pin is disengaged from the seating groove.

4. The detent hood hinge of claim 1, wherein when the hinge arm is in a state of being raised at a predetermined angle, the sleeve pin is seated on the seating groove, and when the hinge arm rotates so as to be further raised, the sleeve pin is disengaged from the seating groove.

* * * * *